United States Patent [19]

Schjeldahl

[11] 4,364,716

[45] Dec. 21, 1982

[54] SURGICAL PUMPING OPERATION

[75] Inventor: Gilmore T. Schjeldahl, Minnetonka, Minn.

[73] Assignee: Cathedyne Corporation, Minnetonka, Minn.

[21] Appl. No.: 236,899

[22] Filed: Feb. 23, 1981

[51] Int. Cl.[3] ..... F04B 17/04; F04B 35/04

[52] U.S. Cl. ..... 417/394; 128/214 F; 417/479

[58] Field of Search ..... 128/214 F, 214 E, 1 D, 128/DIG. 3, 12, 13; 417/394, 479, 478

[56] References Cited

U.S. PATENT DOCUMENTS

| | | | |
|---|---|---|---|
| 3,007,416 | 11/1961 | Childs | 417/479 X |
| 3,062,153 | 11/1962 | Losey | 417/394 |
| 3,194,170 | 7/1965 | Ulbing | 417/394 |
| 3,304,881 | 2/1967 | Grise | 417/394 |
| 3,526,223 | 1/1970 | Curtis | 417/394 X |

*Primary Examiner*—Stephen C. Pellegrino

*Attorney, Agent, or Firm*—Orrin M. Haugen; Thomas J. Nikolai

[57] ABSTRACT

A perfusion pump comprising an assembly of inner and outer tubes interconnected by a field of perforations, a chamber configured to closely contain the tube assembly, valving apparatus for substantially closing the ends of the inner tube by compression against the chamber, and sources of positive and negative pressure gas selectively applicable against the wall of the outer tube.

5 Claims, 3 Drawing Figures

SURGICAL PUMPING OPERATION

FIELD OF THE INVENTION

This invention relates to the field of surgery, and more specially to apparatus for use in providing a flow of a patient's own blood when needed for perfusion and other surgical practices.

BACKGROUND OF THE INVENTION

There are surgical procedures in which it is desirable to have available a flow of the patient's own blood for perfusion. An example is coronary transluminal angioplasty with coronary perfusion. For such purposes, it is customary to draw blood from the patient's femoral artery for use in the perfusion.

SUMMARY OF THE INVENTION

The present invention comprises a pump having an input which may be connected to a catheter inserted in the patient's femoral artery or other convenient location, and an output which may be connected to a CTA/CP (coronary transluminal angioplasty/coronary perfusion) catheter to supply perfusion blood reliably and safely as long as is needed, without causing mechanical damage to the blood. A CTA/CP catheter suitable for this use is taught in the co-pending patent application of Gilmore T. Schjeldahl et al., Ser. No. 185,273, filed Sept. 8, 1980, and assigned to the assignee of the present application.

Various advantages and features of novelty which characterize my invention and are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals indicate corresponding parts throughout the several views.

DESCRIPTION OF THE PREFERRED EMBODIMENT

Figure 1:
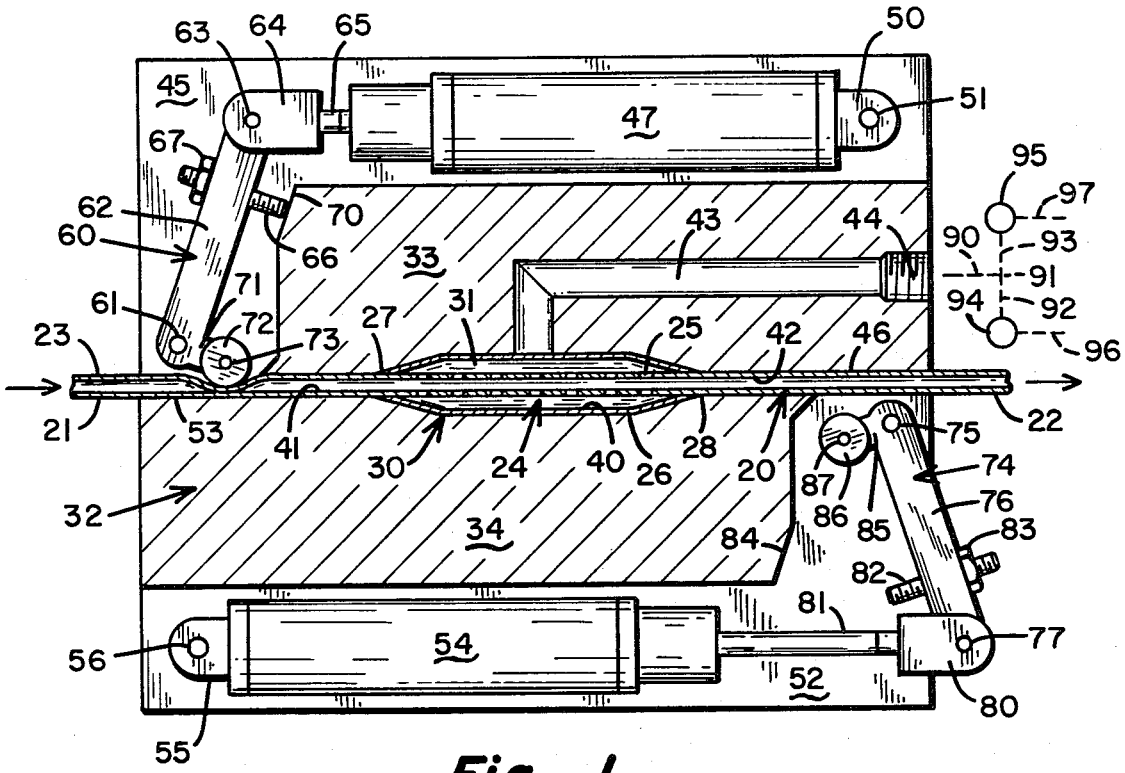
FIG. 1 is a plan view of the invention, with parts broken away for clarity of illustration.
Figure 2:
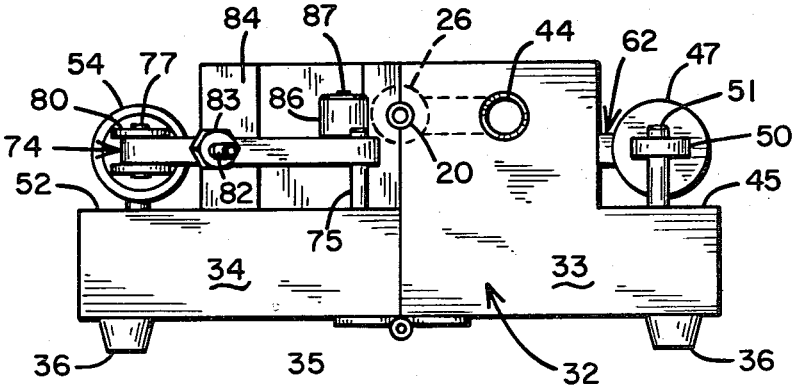
FIG. 2 is an end view of the invention seen from the left of FIG. 1.

A pump according to the invention is shown in the drawings to comprise an inner flexible, resilient tube 20 having an inlet end 21 and an outlet end 22. The wall 23 of tube 20 is provided, at a medial site between ends 21 and 22, with a field 24 of perforations 25. Inlet end 21 is to be connected to a catheter in a patient's femoral artery or other advantageous source of patient's blood, and outlet end 22 is to be connected to a CTA/CP catheter or other perfusion apparatus.

An outer flexible resilient tube 26, of a length somewhat greater than that of the field of perforations in tube 20, surrounds the inner tube in the region of the field. At its ends 27 and 28, tube 26 is secured in fluid tight relation around tube 20. The dimensions of the tube assembly 30 are such that a space 31 between the tubes has a desired volume of, for example, 2 milliliters.

The tube assembly is contained in a chamber 32 made up of two portions 33 and 34 interconnected by a hinge 35 and provided with supporting feet 36. A cavity is formed jointly in portions 33 and 34 along their abutting surfaces, and has a central portion 40 configured to closely enclose tube 26, and end portions 41 and 42 configured to closely enclose tube 20 where it extends beyond tube 26. Portion 33 is further provided with a bore 43 opening inwardly to central portion 40 of the cavity, and outwardly to a threaded connection 44 for receiving metal tubing.

Portion 33 is configured with a horizontal ledge 45 at one end and a vertical wall 46 at the other end. A solenoid 47 is mounted on ledge 45 by a clevis 50 and a vertical pivot 51. Portion 34 is configured with a horizontal ledge 52 at one end and a vertical wall 53 at the other end. A solenoid 54 is mounted on ledge 52 by a clevis 55 and a vertical pin 56.

A first bell crank 60 is pivoted on a vertical pin 61 extending upward from ledge 45. The long arm 62 of the bell crank is pivotally connected by a vertical pin 63 and a clevis 64 to the movable armature 65 of solenoid 47, and carries a stop screw 66 and lock nut 67 for limiting the inward stroke of the armature by engagement with portion 33 at an abutment 70. The short arm 71 of crank 60 carries a roller 72 on a vertical pivot pin 73.

A second bell crank 74 is pivoted on a vertical pin 75 extending upward from ledge 52. The long arm 76 of the bell crank is pivotally connected by a vertical pin 77 and a clevis 80 to the armature 81 of solenoid 54, and carries a stop screw 82 and lock nut 83 for limiting the inward stroke of the armature by engagement with portion 34 at an abutment 84. The short arm 85 of crank 74 carries a roller 86 on a vertical pivot pin 87.

The function of solenoids 47 and 54 is to open and close the ends of tube 20 as desired. In FIG. 1, solenoid 47 is shown with its armature retracted, so that stop screw 66 engages abutment 70. In this situation, roller 73 compresses tube 21 against wall 53 so as to practically close the tube, leaving only a very small gap. Solenoid 54 is shown with its armature extended. In this situation, roller 86 disengages tube 20 to enable it to expand to its full diameter.

Figure 3:
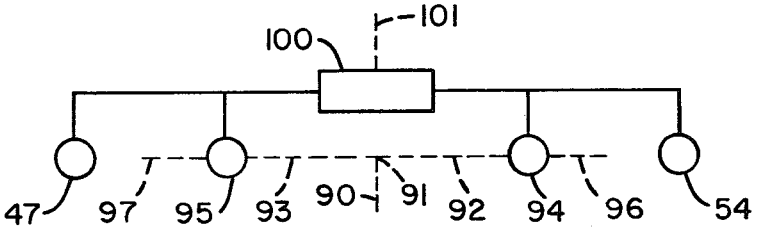
FIG. 3 is a schematic diagram showing the operation of the invention.

As shown in FIG. 1, bore 43 is connected at 44 by a tube 90, a tee 91, and a pair of tubes 92 and 93, to a pair of valves 94 and 95 which are connected respectively to a source 96 of gas under pressure and a source of vacuum 97. Helium is the preferred gas, and the usual regulators are to be provided for the negative and positive pressure sources. Valves 94 and 95, as well as solenoids 47 and 54, are controlled by a supervisory apparatus or sequencing switch 100 in a manner shown schematically in FIG. 3.

The sequence of operation is such as to draw blood into tube 20 at end 21 and through apertures 25 into space 31, then to impel the blood out of space 31 and out of tube 20 at end 22. To do this, sequencer 100 first retracts armature 81 and opens valve 95, admitting negative pressure to bore 43 to expand outer tube 26 fully and maximize space 31, thus drawing blood in at tube end 21 and through apertures 26 into space 31. Valve 95 is then closed, armature 81 is extended, armature 65 is retracted, and valve 94 is opened, admitting helium gas under pressure to bore 43 to compress outer tube 26 and impel the blood out of space 31 through apertures 25 and tube end 22. The fact that rollers 72 and 86 do not completely close tube 20 does not materially degrade the efficiency of the pump, but does avoid mechanical damage to the blood by crushing any of its cellular components.

While sequencer 100 may operate in an arbitrary time sequence, it is desirable that its operation be synchronized or coordinated with the patient's own heartbeat, and to that end a signal from a suitable sensor may be supplied to sequencer 100 as suggested at 101.

From the foregoing it will be evident that I have invented a safe, reliable pump for supplying, for use in coronary perfusion for example, blood from a patient's artery. The pump operates in a manner which results in minimum mechanical damage to the blood. It meets all the requirements for use in an operative environment, and is adapted to have its operation coordinated with the patient's own heartbeat.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. A pump comprising, in combination:

an inner flexible resilient tube extending along an axis and having an inlet end, an outlet end, and a wall with a field of perforations therethrough located medially between said ends;

an outer flexible resilient tube of larger diameter coaxial with and surrounding said inner tube in the region of said field;

means sealing the ends of said outer tube around the wall of said inner tube at sites beyond said field to define between said tubes a hollow, generally cylindrical space of predetermined normal volume;

a housing defining a chamber configured to closely receive said tubes, said housing comprising two rigid portions meeting along a surface containing the axis of said tubes;

means mutually hinging said portions to separate along said surface, for insertion and removal of said tubes;

means in one of said portions connected to said chamber in the area of said field for subjecting said outer tube to positive and negative air pressures to compress and expand said outer tube; and means carried by said housing and separately actuable to compressively close the ends of said inner tubes.

2. A pump comprising, in combination:

an inner flexible resilient tube extending along an axis and having an inlet end, an outlet end, and a wall with a field of perforations therethrough located medially between said ends;

an outer flexible resilient tube of larger diameter coaxial with and surrounding said inner tube in the region of said field;

means sealing the ends of said outer tube around the wall of said inner tube at sites beyond said field to define between said tubes a hollow, generally cylindrical space of predetermined normal volume;

a housing defining a chamber configured to closely receive said tubes, said housing comprising two rigid portions meeting along a surface containing the axis of said tubes, each housing portion comprising a wall engaged by said inner tube at a site remote from one end of said field, a roller for engaging said inner tube at a site remote from the other end of said field, and means for actuating said roller into and out of engagement with said inner tube;

means mutually hinging said portions to separate along said surface, for insertion and removal of said tubes; and means in one of said portions connected to said chamber in the area of said field for subjecting said outer tube to positive and negative air pressures to compress and expand said outer tube.

3. Apparatus according to claim 2 together with means operable to actuate one of said roller actuating means to close the outlet end of said inner tube and simultaneously to apply negative pressure to said outer tube in said chamber.

4. A pump according to claim 2 and means operative to actuate one of said rollers to close the inlet end of said inner tube and simultaneously to apply positive pressure to said outer tube in said chamber.

5. A pump according to claim 2 together with means operable to first actuate one of said roller actuating means to close the outlet end of said tube and simultaneously apply negative pressure to said outer tube in said chamber, and to subsequently actuate the other of said roller activating means to close the inlet end of said inner tube and simultaneously apply positive pressure to said outer tube in said chamber.

* * * * *

UNITED STATES PATENT AND TRADEMARK OFFICE

CERTIFICATE OF CORRECTION

PATENT NO. : 4,364,716

DATED : December 21, 1982

INVENTOR(S) : Gilmore T. Schjeldahl

It is certified that error appears in the above-identified patent and that said Letters Patent are hereby corrected as shown below:

Column 4, Line 40, Claim 4, "rollers" should read -- roller actuating means --.

Signed and Sealed this

*Twenty-second* Day of *February 1983*

[SEAL]

*Attest:*

GERALD J. MOSSINGHOFF

*Attesting Officer*

*Commissioner of Patents and Trademarks*